US006065750A

United States Patent [19]

Mattoon et al.

[11] Patent Number: 6,065,750

[45] Date of Patent: May 23, 2000

[54] MAZE BOARD GAME

[76] Inventors: Terry L. Mattoon, P.O. Box 265, Phelps, N.Y. 14532; Tod J. Ruthven, 42D Brambury Dr., Rochester, N.Y. 14621

[21] Appl. No.: 09/130,097

[22] Filed: Aug. 6, 1998

[51] Int. Cl.[7] ..... A63F 3/00

[52] U.S. Cl. ..... 273/249; 273/280; 273/287

[58] Field of Search ..... 273/280, 287, 273/246, 249

[56] References Cited

U.S. PATENT DOCUMENTS

| | | | |
|---|---|---|---|
| 1,780,256 | 11/1930 | Walss | 273/280 |
| 2,237,707 | 4/1941 | Lazenby | 273/280 |
| 4,188,034 | 2/1980 | Dempsey et al. | 273/248 |
| 5,106,098 | 4/1992 | Filiczkowski | 273/246 |

FOREIGN PATENT DOCUMENTS

| | | | |
|---|---|---|---|
| 8103285 | 11/1981 | WIPO | 273/280 |

*Primary Examiner*—Benjamin H. Layno

[57] ABSTRACT

A maze board game for providing an enjoying game for a number of players. The board game includes a base member and a generally transparent top member spaced above the base member. A middle board is interposed between the base member and the top member. The middle board is rotatably mounted to the base member. The middle board has a plurality of generally rectangular playing spaces arranged in a grid has a number of columns and a number of rows extending generally perpendicular to the columns. The playing spaces include a plurality of starting spaces, a plurality of barrier spaces, a plurality of exchange spaces, and a plurality of loss of turn spaces. The middle board also has a generally rectangular ending space.

8 Claims, 3 Drawing Sheets

MAZE BOARD GAME

BACKGROUND OF THE INVENTION

1. Field of the Invention

The present invention relates to board games and more particularly pertains to a new maze board game for providing an enjoying game for a number of players.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,712,617; U.S. Pat. No. 4,332,385; U.S. Pat. No. 4,252,320; U.S. Pat. No. Des. 268,771; U.S. Pat. No. 4,448,421; and U.S. Pat. No. 2,273,009.

While these devices fulfill their respective, particular objectives and requirements, the aforementioned patents do not disclose a new maze board game. The inventive device includes a base member and a generally transparent top member spaced above the base member. A middle board is interposed between the base member and the top member. The middle board is rotatably mounted to the base member. The middle board has a plurality of generally rectangular playing spaces arranged in a grid has a number of columns and a number of rows extending generally perpendicular to the columns. The playing spaces include a plurality of starting spaces, a plurality of barrier spaces, a plurality of exchange spaces, and a plurality of loss of turn spaces. The middle board also has a generally rectangular ending space.

In these respects, the maze board game according to the present invention substantially departs from the conventional concepts and designs of the prior art, and in so doing provides an apparatus primarily developed for the purpose of providing an enjoying game for a number of players.

SUMMARY OF THE INVENTION

In view of the foregoing disadvantages inherent in the known types of board games now present in the prior art, the present invention provides a new maze board game construction wherein the same can be utilized for providing an enjoying game for a number of players.

The general purpose of the present invention, which will be described subsequently in greater detail, is to provide a new maze board game apparatus and method which has many of the advantages of the board games mentioned heretofore and many novel features that result in a new maze board game which is not anticipated, rendered obvious, suggested, or even implied by any of the prior art board games, either alone or in any combination thereof.

To attain this, the present invention generally comprises a base member and a generally transparent top member spaced above the base member. A middle board is interposed between the base member and the top member. The middle board is rotatably mounted to the base member. The middle board has a plurality of generally rectangular playing spaces arranged in a grid has a number of columns and a number of rows extending generally perpendicular to the columns. The playing spaces include a plurality of starting spaces, a plurality of barrier spaces, a plurality of exchange spaces, and a plurality of loss of turn spaces. The middle board also has a generally rectangular ending space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new maze board game apparatus and method which has many of the advantages of the board games mentioned heretofore and many novel features that result in a new maze board game which is not anticipated, rendered obvious, suggested, or even implied by any of the prior art board games, either alone or in any combination thereof.

It is another object of the present invention to provide a new maze board game which may be easily and efficiently manufactured and marketed.

It is a further object of the present invention to provide a new maze board game which is of a durable and reliable construction.

An even further object of the present invention is to provide a new maze board game which is susceptible of a low cost of manufacture with regard to both materials and labor, and which accordingly is then susceptible of low prices of sale to the consuming public, thereby making such maze board game economically available to the buying public.

Still yet another object of the present invention is to provide a new maze board game which provides in the apparatuses and methods of the prior art some of the advantages thereof, while simultaneously overcoming some of the disadvantages normally associated therewith.

Still another object of the present invention is to provide a new maze board game for providing an enjoying game for a number of players.

Yet another object of the present invention is to provide a new maze board game which includes a base member and a generally transparent top member spaced above the base member. A middle board is interposed between the base member and the top member. The middle board is rotatably mounted to the base member. The middle board has a plurality of generally rectangular playing spaces arranged in a grid has a number of columns and a number of rows extending generally perpendicular to the columns. The playing spaces include a plurality of starting spaces, a plurality of barrier spaces, a plurality of exchange spaces, and a plurality of loss of turn spaces. The middle board also has a generally rectangular ending space.

Still yet another object of the present invention is to provide a new maze board game that makes players move along a playing surface where the obstacles change location as the game progresses.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
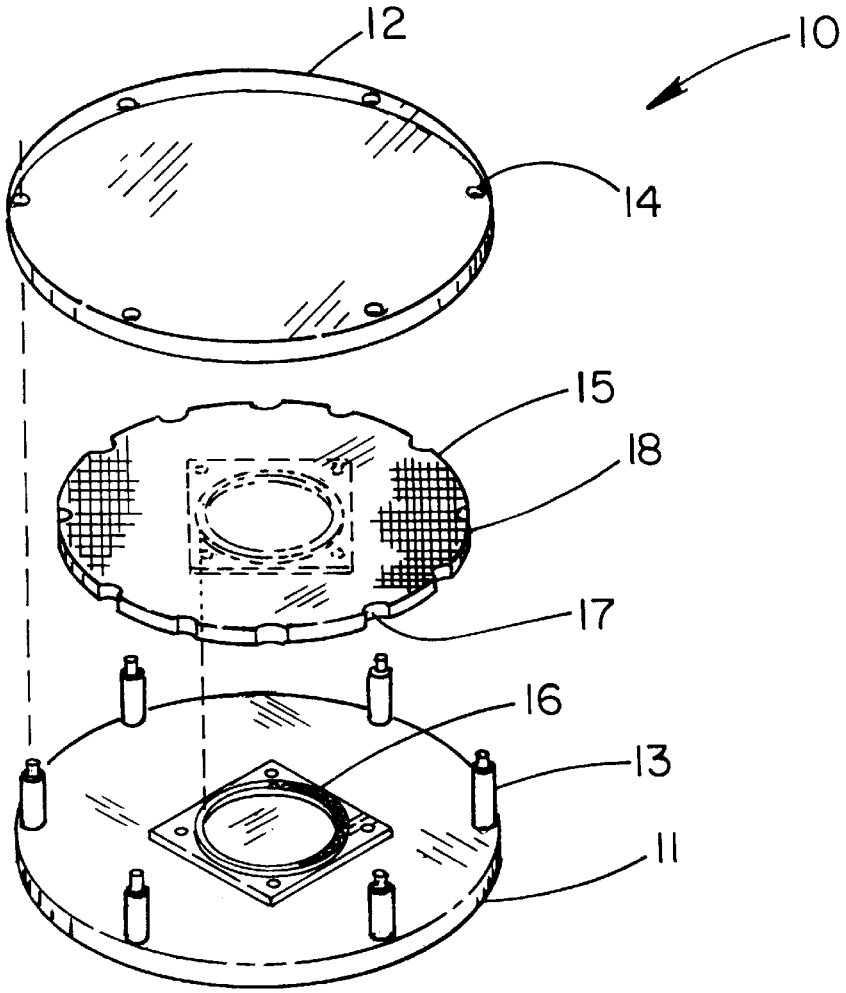
FIG. 1 is a schematic exploded perspective view of a new maze board game according to the present invention.
Figure 2:
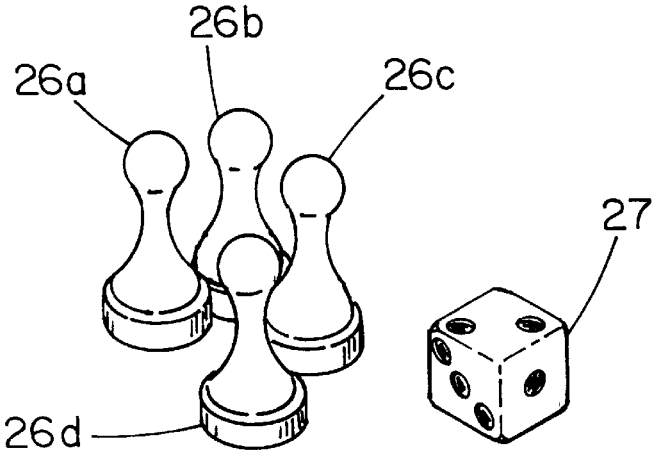
FIG. 2 is a schematic perspective view of the playing pieces and the die of the present invention.
Figure 3:
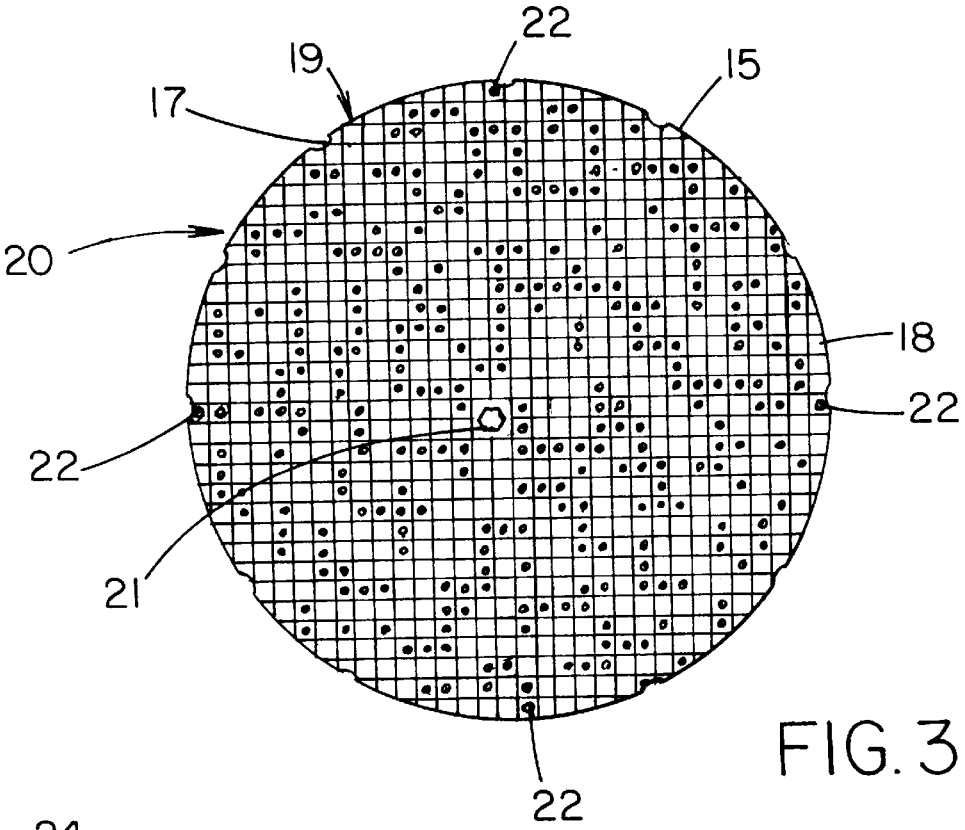
FIG. 3 is a schematic top side view of the top surface of the middle board of the present invention.
Figure 4:
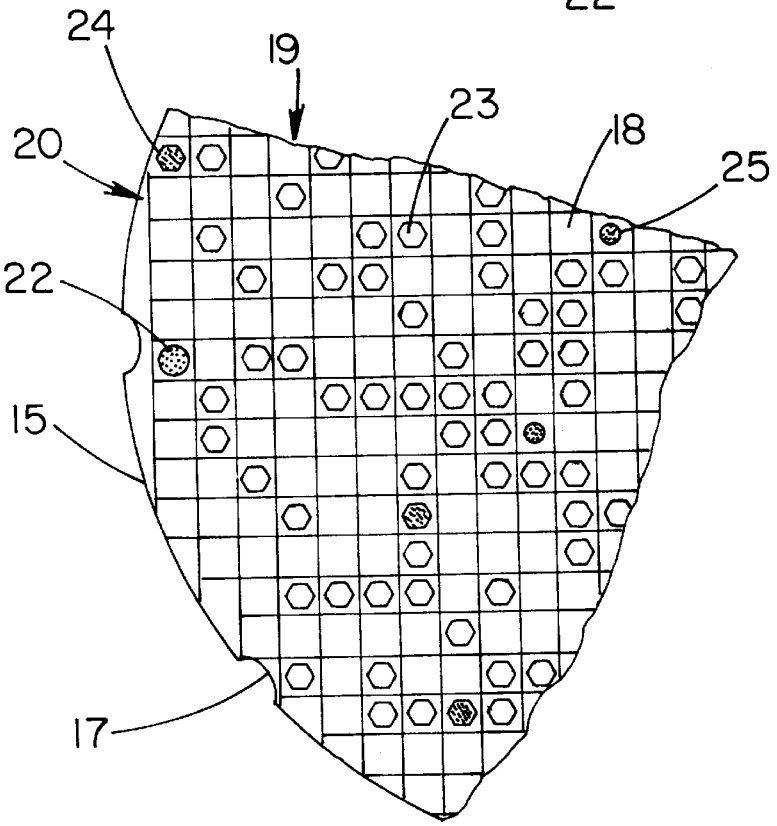
FIG. 4 is a schematic partial top side view of the top surface of the middle board of the present invention.
Figure 5:
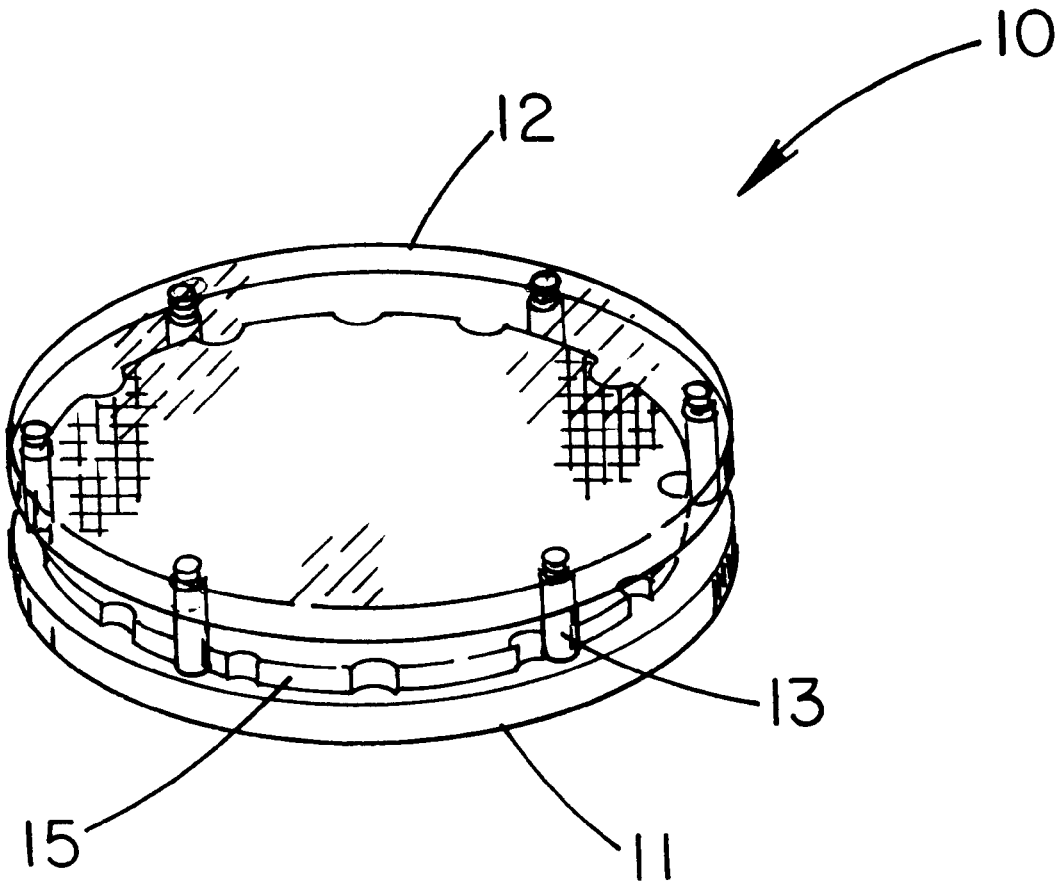
FIG. 5 is a schematic perspective view of the present invention.

With reference now to the drawings, and in particular to FIGS. 1 through 5 thereof, a new maze board game embodying the principles and concepts of the present invention and generally designated by the reference numeral 10 will be described.

As best illustrated in FIGS. 1 through 5, the maze board game 10 generally comprises a base member 11 and a generally transparent top member 12 spaced above the base member 11. A middle board 15 is interposed between the base member 11 and the top member 12. The middle board 15 is rotatably mounted to the base member 11. The middle board 15 has a plurality of generally rectangular playing spaces 18 arranged in a grid. The grid has a number of columns 19 and a number of rows 20 extending generally perpendicular to the columns 19. The playing spaces 18 include a plurality of starting spaces 22, a plurality of barrier spaces 23, a plurality of exchange spaces 24, and a plurality of loss of turn spaces 25. The middle board 15 also has a generally rectangular ending space 21.

In closer detail, the board game 10 also includes a number of playing pieces 26*a–d*, with one playing piece for each player. Also provided is a six sided die.

Specifically, the board game 10 comprises a base member 11 for resting on a surface which is generally circular and has a center, a generally circular outer perimeter, a diameter, and generally planar upper and lower surfaces. A top member 12 is spaced above the base member 11. The top member 12 is generally transparent and generally circular with a center, a generally circular outer perimeter, a diameter and generally planar upper and lower surfaces. In use the playing pieces are rested on the upper surface of the top member. Preferably, the base member 11 and top member 12 lie in generally parallel planes with the centers of the base member 11 and the top member 12 generally coaxial. Ideally, the upper surface of the top member 12 is spaced apart from the lower surface of the base member 11 about 2 inches. A plurality of support legs 13 extend between the base and the top member 12 to support the top member 12 above the base member 11. Each of the support legs 13 is generally cylindrical and has a longitudinal axis extending generally perpendicular to the planes of the base member 11 and top member 12. Each of the support legs 13 has a lower end coupled to the upper surface of the base member 11. The top member 12 has a plurality of holes 14 therethrough between the upper and lower surfaces of the top member 12. Each support leg 13 is associated with a hole 14 of the top member 12. Each of the support legs 13 has an upper end inserted into the associated hole of the top member 12. The support legs 13 are spaced apart from one another and positioned along the outer perimeters of the base member 11 and the top member 12.

A middle board 15 is interposed between the base member 11 and the top member 12. The middle board 15 is generally circular having a center, a generally circular outer perimeter, a diameter, and generally planar top and bottom surfaces. The middle board 15 the center of the middle board 15 is coaxial with the centers of the base member 11 and the top member 12. Preferably, the diameter of the middle board 15 is less than either of the diameters of the base member 11 and the top member 12 and the diameters of the base member 11 and the top member 12 are generally equal to one another. In an ideal illustrative embodiment, the diameters of the base member 11 and the top member 12 are each about 24 inches and the diameter of the middle board 15 is about 22 inches.

The bottom surface of the middle board 15 is rotatably mounted to the upper surface of the base member 11 by a roller bearing assembly 16 to permit free rotation of the middle board 15 about the center of the middle board 15. The outer perimeter of the middle board 15 has a plurality of finger notches 17 for aiding the rotating of the middle board 15 with a finger of a player. The finger notches 17 are spaced apart from one another around the outer perimeter of the middle board 15 at generally equal intervals. Because the playing pieces rest on the upper surface of the top member, the middle board can be free to rotate without disturbing position of the playing pieces on the top member.

The upper surface of the middle board 15 has a plurality of generally rectangular playing spaces 18 arranged in a grid. The grid has a number of columns 19 and a number of rows 20 extending generally perpendicular to the columns 19. The playing spaces 18 are generally of equal size. Each playing space has a number of adjacent playing spaces therearound including laterally adjacent playing spaces and diagonally adjacent playing spaces. The upper surface of the middle board 15 also has a generally rectangular ending space 21. The ending space 21 is located at the center of the middle board 15. The ending space 21 preferably has an area of about four regular playing spaces 18. The ending space 21 preferably has a hexagonal indicia of a first color such as blue thereon to indicate the ending space 21 to the players. The playing spaces 18 further includes a plurality of starting spaces 22. The playing spaces 18 are located in the grid adjacent the outer perimeter of the middle board 15. The starting spaces 22 are preferably generally equally spaced apart around the outer perimeter of the middle board 15 at generally equal intervals. Ideally, the plurality of starting spaces 22 comprises four starting spaces 22 (one for each player) such that the starting spaces 22 form arcs having an angle of about 90 degrees. The starting spaces 22 each preferably have a circular indicia of the first color thereon to indicate the starting spaces 22 to the players.

The playing spaces 18 also include a plurality of barrier spaces 23. The barrier spaces 23 each have a hexagonal indicia of a second color such as red thereon to indicate the barrier spaces 23 to the players. The playing spaces 18 additionally include a plurality of exchange spaces 24. The exchange spaces 24 each has a hexagonal indicia of a third color such as yellow thereon to indicate the exchange spaces 24 to the players. The playing spaces 18 also include a plurality of loss of turn spaces 25. The loss of turn spaces 25 each has a circular indicia of a fourth color such as green thereon to indicate the loss of turn spaces 25 to the players. As the middle board is spun, the locations of these playing spaces is changed with respect to the playing pieces on the top member.

The object of the game is for each player to mover their playing piece from the designated starting space to the ending space. To begin play, each player rolls the die and the one with the highest roll starts the game first. All ties between players are broken by subsequent rolls. This is the only time that the roll of the die precedes the turn of the game board. Each player takes a turn (in a clockwise rotation) with the highest rolling player starting first. Each turn comprises spinning the middle board so that it revolves one full revolution and, when the middle board stops spinning, rolling the die and moving the player's playing piece a number of playing spaces equal to the rolled value (Example: A roll of 4 allows a movement of four spaces). All movement of the playing surface is done by the roll of the die.

Each player in turn must spin the playing board so that it revolves at least once completely around. Once the board stops the player then rolls the die and moves their playing piece accordingly. Since the middle board is circular, the middle board does not always align itself with a player's piece above on the top member. Before moving, a player may slightly rotate the board clockwise for a more defined alignment so that the majority of the playing pieces are each in a playing space. If a player's piece lands on a barrier space after the middle board is spun, the player must move their playing piece to nearest laterally located playing space (and not a diagonally located playing space) to the barrier space. Once the playing piece is repositioned, the player may then roll the die and move the playing piece accordingly.

The special playing spaces have different features that make the game unique and interesting to play every turn. The barrier spaces are barriers to playing piece movement. The barrier spaces cannot be passed through and must only move around them. The exchange spaces come into play only if a player moves onto them after rolling the die. They do not have any effect if a playing piece is in one from a spin of the middle board (when they are treated as regular playing spaces). When a playing piece moves on to an exchange space by moving the exact count of the die roll, that playing piece can exchange locations with any other playing piece on the top member. This allows pieces close to the outer perimeter of the middle board to get closer to the center and vice versa. The loss of turn squares come into play only after a spin of the middle board. If the playing piece of the person spinning the middle board ends up on a loss of turn square, that player losses the rest of his turn and cannot roll the die to move his piece that turn. It should be noted that a player may move a piece on a barrier after a spin on to a loss of turn square, however, they do lose the rest of their turn.

Movement is allowed in any direction that is not blocked by a barrier space or that is not diagonal. Any open space is able to be occupied unless it means taking over a space occupied by another playing piece. Playing pieces may be along side one another but not in the same playing space. Pieces may jump over other pieces to complete their move. If a player has only one option for moving and it requires taking over the spot of another player's playing piece, it can only move up to the other playing piece and then stop. Playing pieces may move in any direction (non diagonal) from the center including closer and further away from the center. A playing piece may move in a box fashion as long as it does not retrace its move or count a playing space twice in the same turn.

A player wins the game by being the first player to move their playing piece to the ending space. A playing piece may only enter the ending space by moving the exact number of playing spaces as was rolled that turn.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A board game, comprising:

a base member;

a generally transparent top member being spaced above said base member;

a middle board being interposed between said base member and said top member;

said middle board being rotatably mounted to said base member;

said middle board having a plurality of playing spaces arranged in a grid having a number of columns and a number of rows extending generally perpendicular to said columns;

said outer perimeter of said middle board having a plurality of finger notches, said finger notches being spaced apart from one another around said outer perimeter of said middle board at generally equal intervals;

said upper surface of said middle board having an ending space;

said playing spaces including a plurality of starting spaces;

said playing spaces including a plurality of barrier spaces;

said playing spaces including a plurality of exchange spaces;

said playing spaces including a plurality of loss of turn spaces.

2. The board game of claim 1, wherein said base member, said top member, and said middle member are all generally circular and each has a center, an outer perimeter, a diameter, and generally planar upper and lower surfaces.

3. The board game of claim 2, wherein said centers of said base member, said top member, and said middle member are generally coaxial.

4. The board game of claim 2, wherein said diameter of said middle board is less than either of said diameters of said base member and said top member.

5. The board game of claim 2, wherein said diameters of said base member and said top member are generally equal to one another.

6. The board game of claim 1, wherein said ending space has a hexagonal indicia of a first color thereon to indicate the ending space to the players, wherein said starting spaces each have a circular indicia of the first color thereon to indicate the starting spaces to the players, wherein said barrier spaces each have a hexagonal indicia of a second color thereon to indicate the barrier spaces to the players, wherein said exchange spaces each have a hexagonal indicia of a third color thereon to indicate the exchange spaces to the players, and wherein said loss of turn spaces each have a circular indicia of the fourth color such thereon to indicate the loss of turn spaces to the players.

7. The board game of claim 1, further comprising a plurality of support legs extending between said base and said top member to support said top member above said base member.

8. A board game, comprising:

a base member being generally circular and having a center, an outer perimeter, a diameter, and generally planar upper and lower surfaces;

a generally transparent top member being generally circular and having a center, an generally circular outer perimeter, a diameter and generally planar upper and lower surfaces, said top member being spaced above said base member, said base member and top member lying in generally parallel planes, said centers of said base member and said top member being generally coaxial;

wherein said upper surface of said top member is spaced apart from said lower surface of said base member about 2 inches;

a plurality of support legs extending between said base and said top member to support said top member above said base member, each of said support legs being generally cylindrical and having a longitudinal axis extending generally perpendicular to the planes of said base member and top member;

each of said support legs having a lower end coupled to said upper surface of said base member;

said top member having a plurality of holes therethrough between said upper and lower surfaces of said top member, each support legs being associated with a holes of said top member, each of said support legs having an upper end inserted into the associated hole of said top member;

said support legs being spaced apart from one another and positioned along the outer perimeters of said base member and said top members;

a middle board being generally circular and having a center, an outer perimeter, a diameter, and generally planar top and bottom surfaces;

said middle board being interposed between said base member and said top member, said center of said middle board being coaxial with said centers of said base member and said top member;

wherein said diameter of said middle board is less than either of said diameters of said base member and said top member, wherein said diameters of said base member and said top member are generally equal to one another, wherein said diameters of said base member and said top member are each about 24 inches, wherein said diameter of said middle board is about 22 inches;

said bottom surface of said middle board being rotatably mounted to said upper surface of said base member to permit free rotation of said middle board about said center of said middle board;

said outer perimeter of said middle board having a plurality of finger notches, said finger notches being spaced apart from one another around said outer perimeter of said middle board at generally equal intervals;

said upper surface of said middle board having a plurality of generally rectangular playing spaces arranged in a grid having a number of columns and a number of rows extending generally perpendicular to said columns, said playing spaces being generally of equal size;

each playing space having a number of adjacent playing spaces therearound including laterally adjacent playing spaces and diagonally adjacent playing spaces;

said upper surface of said middle board having a generally rectangular ending space, said ending space being located at said center of said middle board, said ending space having an area of about four playing spaces, said ending space having a hexagonal indicia of a first color thereon to indicate the ending space to the players;

said playing spaces including a plurality of starting spaces, said playing spaces being located in said grid adjacent said outer perimeter of said middle board, said starting spaces being generally equally spaced apart around said outer perimeter of said middle board at generally equal intervals, wherein said plurality of starting spaces comprises four starting spaces, said starting spaces each having a circular indicia of the first color thereon to indicate the starting spaces to the players;

said playing spaces including a plurality of barrier spaces, said barrier spaces each having a hexagonal indicia of a second color thereon to indicate the barrier spaces to the players;

said playing spaces including a plurality of exchange spaces, said exchange spaces each having a hexagonal indicia of a third color thereon to indicate the exchange spaces to the players; and said playing spaces including a plurality of loss of turn spaces, said loss of turn spaces each having a circular indicia of a fourth color thereon to indicate the loss of turn spaces to the players.

* * * * *